United States Patent [19]

Brothers, deceased et al.

[11] 4,049,008

[45] Sept. 20, 1977

[54] HAIR-CURLING DEVICE

[76] Inventors: Richard V. Brothers, deceased, late of Fontana, Calif.; by Magdalena M. Brothers, executrix, 17388 Merrill, Fontana, Calif. 92335

[21] Appl. No.: 693,339

[22] Filed: June 7, 1976

[51] Int. Cl.[2] ..... A45D 1/00

[52] U.S. Cl. ..... 132/33 B; 132/11 A; 132/41 B

[58] Field of Search ..... 132/9, 40, 41, 42

[56] References Cited

U.S. PATENT DOCUMENTS

| | | | |
|---|---|---|---|
| 2,429,176 | 10/1947 | Watson | 132/40 |
| 2,910,989 | 11/1959 | Russell | 132/40 |
| 3,103,223 | 9/1963 | Trabish | 132/41 |
| 3,974,841 | 8/1976 | Weisman | 132/40 |

*Primary Examiner*—G.E. McNeill
*Attorney, Agent, or Firm*—John H. Crowe

[57] ABSTRACT

The device has a slitted spool and a slitted sleeve thereabout, each having a longitudinal slot registrable with each other, the spool being detachably mounted on a hollow handle having a slot registrable with the slots in the spool and sleeve. The handle contains a longitudinally movable comb extendable to comb a lock of hair and retractable for drawing the end portion of the lock into the registered slots. The handle and sleeve are manipulated to dispose the lock end portion between the spool and the sleeve, and anchor the same therebetween, further manipulation of the handle turning the spool and sleeve as a unit for winding the lock of hair into a curl coiled about the sleeve. A selectively positionable clasp holds the coiled hair in place as close to the scalp as desired.

2 Claims, 5 Drawing Figures

FIG. 1.
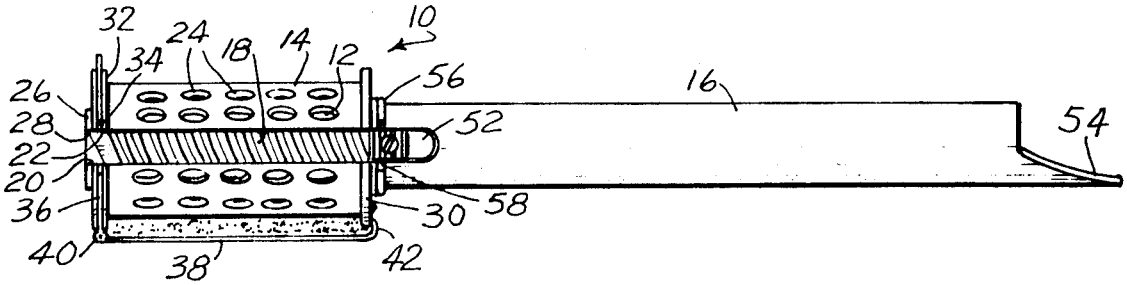
FIG. 2.
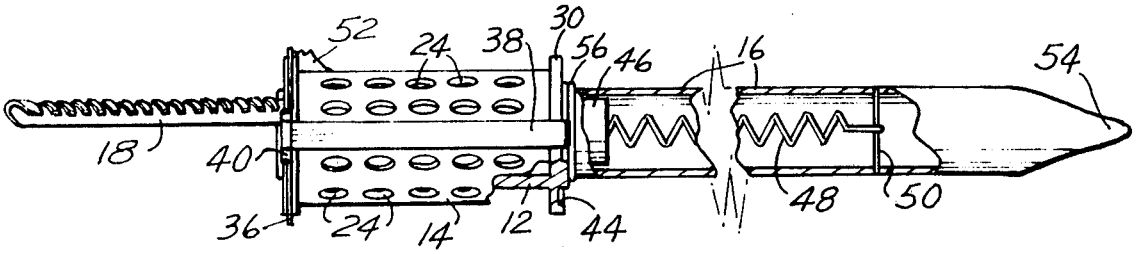
FIG. 4.
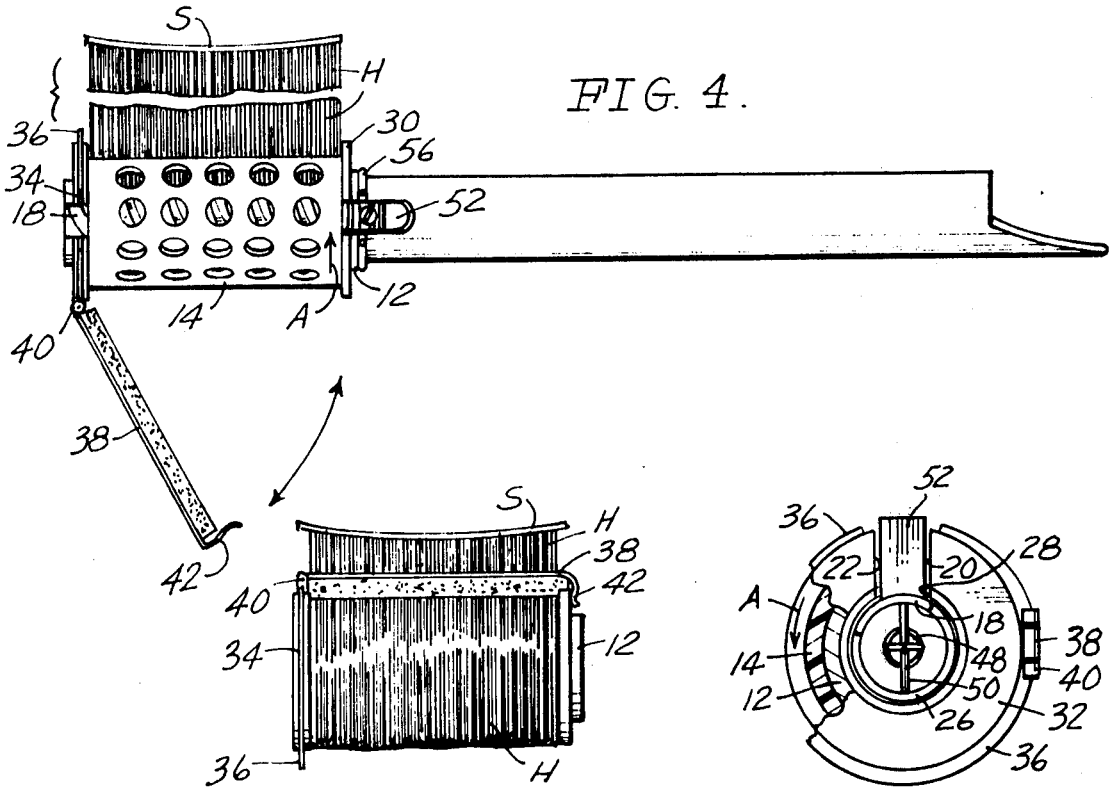
FIG. 5.
FIG. 3.

HAIR-CURLING DEVICE

BACKGROUND OF THE INVENTION

The present invention relates to hair dressing devices and more particularly to a novel device for winding a lock of hair into a curl in a relatively rapid and facile manner. Various devices have been devised for curling hair, as exemplified by U.S. Pat. Nos. 2,225,454; 2,600,730; 2,608,977; 2,785,689; 2,785,690; 2,788,006 and 2,966,158.

The present invention provides a hair curling device of simpler and more economical construction by which an operator with a little practice can coil a lock of hair into a neat, evenly formed hair curl, which curl can be disposed closely adjacent to the scalp of the person whose hair is being curled, and additional adjacent curls can be formed.

SUMMARY OF THE INVENTION

An object of the present invention is to provide a novel and improved form of a device for curling hair in a simple and efficient manner.

Another object is to provide a hair curling device of simple and relatively inexpensive construction.

A further object is to provide a device which forms a lock of hair into a layer of relatively evenly spaced hairs and coiling the layer into a neatly formed curl.

Still another object is to provide a hair curling device which avoids split and crimped ends and permits close adjacent curls to be formed.

These and other objects and advantages of the present invention are achieved by the provision of a hair curling device including a slitted spool and a slitted sleeve disposed thereabout, each having a longitudinal slot therein which are registrable with each other, the spool being detachably mounted on a hollow handle having a slot registrable with the slots in the spool and sleeve and containing a longitudinally movable comb extendable to engage and comb a lock of hair into a layer of relatively evenly spaced hairs extending from the proximal or scalp end of the lock to the distal or free end portion thereof, the comb being retractable for drawing the free end portion of the lock into the register slots, after which the handle and sleeve are manipulated for disposing the lock and portion between the spool and the sleeve and holding it there, further manipulation of the handle serving to turn the spool and sleeve as a unit for winding the layer of hair into a curl coiled about the sleeve. The spool has a flange at each end which prevents slippage of the hair to the sides, one of the flanges having an arcuate groove in the periphery thereof, the groove receiving an arcuate member which is rotatable relative to the spool and mounts a clasp for holding the coiled layer of hair in place, one end of the clasp being pivoted to the arcuate member and the other end detachably connected to the other flange, the movable mounting of the clasp providing for selective positioning of the clasp close to the scalp end of the lock as desired.

BRIEF DESCRIPTION OF THE DRAWING

FIG. 1 is a top plan view of a hair-curling device in accordance with the present invention, and showing the comb means thereof in retracted position;

FIG. 2 is a fragmentary elevational side view of the device of FIG. 1, with parts broken away and showing the comb means in extended position;

FIG. 3 is a larger scale elevational end view of the device, with parts broken away to show structural details;

FIG. 4 is a view somewhat similar to FIG. 1, but showing the device in engagement with a combed lock of hair in an early stage of a hair-curling operation; and FIG. 5 is an elevational side view of the spool and sleeve with a lock of hair curled therearound and detached from the handle.

DESCRIPTION OF PREFERRED EMBODIMENT

Referring to the drawings, there is shown in FIG. 1 a hair-curling device 10 embodying the principles of the present invention and including a substantially cylindrical slitted spool 12 disposed about which is a substantially cylindrical slitted sleeve 14, the spool being detachably mounted on a hollow handle 16 within which comb means 18 is mounted for longitudinal movement. The comb means is extendable as shown in FIG. 2. The spool 12 is preferably made of a suitable hard material, and has its side slitted to provide a longitudinal slot 20. Sleeve 14 is similarly slotted to provide a longitudinal slot 22 therein, and is preferably made of a flexible material, such as plastic, for easy slipping thereof over the spool. The sleeve is also provided with a plurality of perforations 24 or otherwise foraminously formed. The spool is also foraminous. The slot 20 is sleeve 12 is registrable with slot 22 in spool 14, and the handle 16 has a substantially cylindrical end portion 26 that is provided with a longitudinal slot 28 that registers with the slots 20 and 22, as shown in FIG. 1.

The spool 12 is provided with end flanges 30 and 32, the latter having an outwardly facing shallow groove 34 in the periphery thereof. Received in the groove 34 is the inner edge portion of an arcuate member 36, better seen in FIG. 3, which can be turned relative to the spool. The member 36 mounts a hair holding means or clasp 38 by means of a pivotal connection 40, the clasp having a spring finger 42 engageable with the flange 30 which has a lip 44 suitable for the purpose (see FIG. 2).

Inviting attention to FIG. 2, the comb means 18 extends from a cylindrical mounting 46 slidable in the handle 16. Connected to the mounting 46 is one end of a coil spring 48, the other end of which is connected to a pin or post 50, suitably secured in the handle 16. Secured to the mounting 46 and projecting through the slot 28 in the end portion 26 of the handle is a control element 52 normally disposed in the slot between the ends of the flange 30. The control element is adapted to be engaged by the thumb of the operator for moving it through the registered slots 20, 22 and 28 and extending the comb means 18, as shown, against the tension of the spring 48 which urges the comb means to retracted position. In extended position, the comb means is used to comb a lock or tress of hair before the curling thereof. The handle 16 is provided with a rattail end 54 which is used to block off the tress of hair to be combed and curled. Spool 12 is frictionally fitted to the cylindrical end portion 26 of the handle 16 for easy detachment therefrom. The poitioning of the spool on the handle is determined by engagement with a snap-ring 56 disposed in a groove 58 formed in the handle 16.

FIG. 4 shows the hair-curling device 10 in engagement with a combed lock of hair H and the sleeve 14 turned to confine the distal end portion of the lock and grasp it between the sleeve and the spool 12, in an early stage of the hair-curling operation. With the slots 20, 22 and 28 in registration, the lock is combed with the comb means 18 in extended position as shown in FIG. 2. After the lock has been combed into a relatively thin layer of generally parallel evenly spaced hairs, the device is manipulated to move it away from the scalp S of the person whose hair is being curled until the comb means engages the free or distal end portion of the hair layer, after which the comb means is retracted and the handle is moved to dispose the distal end portion of the layer in the registered slots. With the clasp 38 in unclasped condition, and disposed as shown in FIG. 4 for disposition in the left hand of the operator of the device, the thumb and forefinger of the operator engages the sleeve 14 fur turning it relative to the spool 12 in the direction of the arrow A (see also FIG. 3). The device is manipulated to move it away from the scalp for drawing the end portion of the hair layer through the comb means and simultaneously turned for moving the edge of the slot 20 of the sleeve 14 over the end portion of the hair layer, thereby grasping and anchoring the end portion between the sleeve and the spool. Thereafter, the device is manipulated to turn the spool and sleeve as a unit, while moving the device toward the scalp, maintaining sufficient tension on the hair for winding it about the sleeve and spool and coiling the hair into a neatly formed curl disposed as close to the scalp S as desired, as shown in FIG. 5. The clasp 38 is then turned for selective positioning thereof with respect to the spool, after which the clasp is locked in place to hold the coiled curl. using additional sleeved spools, the operation is repeated on adjacent locks of hair. It is understood, of course, that suitable solutions are appropriately applied during the operation, and after drying, the clasp is opened and the curled lock is freed from the sleeved spool and recoils into a neatly formed curl.

It is believed that the operation of the hair-curling device of the present invention is readily apparent from the foregoing and is briefly summarized at this point. A lock of hair is blocked off by the rattail end 54 of the handle 16 and combed with the extended comb means 18 into a layer of hair H, the distal end portion of which is then disposed in the registered slots 20, 22 and 28. With the clasp 38 open and disposed in the hand of the operator, the handle and sleeve 14 are manipulated to free the hair end portion from the comb means and grasp it between the sleeve and the spool 12 and to coil the hair layer thereabout. When the hair coil is close to the scalp as desired, the clasp is closed to hold it in place.

There has thus been provided a hair-curling device of simple construction which operates in a relatively rapid facile manner for the efficient forming of a neat curl.

Although the present invention has been herein shown and described in considerable detail in what is believed to be the most practical and preferred embodiment thereof, it is to be understood that many variations thereof are possible and the present invention is not to be limited to such details, but is to be accorded the full scope of the appended claims.

What I claim is:

1. A hair-curling device comprising:

a substantially cylindrical spool-like body with a flange at each of its ends and having a longitudinal slot;

a sleeve-like member disposed about said body and turnable relative thereto for confining an end portion of a lock of hair between the member and the body after which the member and body are turnable as a unit for winding the lock of hair thereabout and forming it into a curl, said member being substantially cylindrical and having a longitudinal slot registrable with the slot in the body;

a hollow structure detachably mounting the body and having a slot registrable with the slots in the body and member;

comb means mounted for longitudinal movement in the hollow structure and disposable in the body, said comb means being extendable for engaging the lock of hair and combing it into a layer of substantially uniform thickness and retractable for disposing the free end portion of the combed lock of hair in the registered slots; and curl holding means movably mounted on the body for engaging the combed lock of hair adjacent the scalp end portion after curling.

2. The device of claim 1 wherein said curl holding means includes a clamp detachably connected to one of said flanges and pivotally connected to an arcuate structure mounted for turning in a groove formed in the other of said flanges.

* * * * *